United States Patent [19]

Decroix et al.

[11] 4,319,104

[45] Mar. 9, 1982

[54] MOVABLE CONTACT UNIT FOR A DIRECT-CURRENT, HIGH-CAPACITY CIRCUIT BREAKER

[75] Inventors: Victor Decroix, Thonon les bains, France; Burkhard Funk, Geneva, Switzerland; Albert Massonnet, Les Hutins de Veraz, France; Hansjörg Weber, Geneva, Switzerland; Alain Zbinden, Chavannes de Bogis, Switzerland

[73] Assignee: BBC Brown, Bovery & Company, Ltd., Baden, Switzerland

[21] Appl. No.: 48,052

[22] Filed: Jun. 13, 1979

[30] Foreign Application Priority Data

Jun. 30, 1978 [CH] Switzerland ..... 7145/78

[51] Int. Cl.[3] ..... H01N 33/18

[52] U.S. Cl. ..... 200/147 R; 200/275; 200/277; 200/281

[58] Field of Search ..... 200/147 R, 146 R, 275, 200/277, 281

[56] References Cited

U.S. PATENT DOCUMENTS

| | | | |
|---|---|---|---|
| 2,764,652 | 9/1956 | Debuit | 200/277 |
| 3,188,590 | 6/1965 | Earley | 200/277 |
| 4,034,177 | 7/1977 | Sims, Jr. | 200/277 |

FOREIGN PATENT DOCUMENTS

| | | | |
|---|---|---|---|
| 263903 | 8/1968 | Austria | 200/277 |
| 621067 | 4/1949 | United Kingdom | 200/277 |

*Primary Examiner*—Robert S. Macon

*Attorney, Agent, or Firm*—Burns, Doane, Swecker & Mathis

[57] ABSTRACT

A moveable electrical contact for a direct-current, high-capacity circuit breaker includes a cylindrical contact body provided with a cylindrical borehole arranged eccentrically on the contact body and extending in a longitudinal direction. An inner body can be arranged in the borehole and connected to a drive rod. This arrangement provides an advantage in that, owing to the eccentric arrangement of the borehole, the breaking current formed during opening of the circuit breaker contacts is forced to form a loop whereby a good quenching of the electric arc is achieved. The construction of the moveable contact is also mechanically quite stable.

10 Claims, 8 Drawing Figures

MOVABLE CONTACT UNIT FOR A DIRECT-CURRENT, HIGH-CAPACITY CIRCUIT BREAKER

BACKGROUND OF THE INVENTION

The present invention relates to an electrical direct-current contact unit, and more particularly to a moveable contact for use in a direct-current, high-capacity circuit breaker.

German Pat. No. 1,202,378 discloses a contact bridge assembly consisting of a plate with electric arc horns which are electrically connected with each other by a bow-shaped electric arc control bracket. Circuit breakers of this type can only be used up to specified rated currents because the cross sectional area of the contact bridge is limited and its heat conductivity is relatively poor. According to German Offenlegungsschrift No. 1,640,262, a contact bridge is constructed in a U-shape and each leg of the bridge has one contact at its end. The current path forms a loop which reinforces the magnetic quenching of the electric arc. The contact bridge is nevertheless not very massive and features a small cross sectional area.

It is an object of the present invention to overcome the disadvantages of these well-known devices and to produce an electrical direct-current contact unit, and more particularly, a moveable contact for a direct-current, high-capacity circuit breaker, which is sufficiently mechanically stable, features a large cross sectional area, possesses good thermal conductivity and forms a current loop during opening of the contacts to thereby cause a magnetic self-quenching of the electric arc.

SUMMARY OF THE INVENTION

These, are well as other objects and advantages, are achieved in accordance with the present invention by providing a direct-current contact unit which contains a contact body provided with an eccentrically arranged borehole extended in the longitudinal direction of the body.

The advantage of providing an eccentric arrangement of a borehole extending in the longitudinal direction of the contact body is that two current paths are produced, one having a larger cross sectional area and one with a smaller area. The position of the larger cross sectional area is selected such that the breaking current flowing through this cross sectional area during opening of the circuit breaker contacts causes a strong magnetic quenching of the electric arc. In addition, the construction of the contact unit is quite rugged.

It is also advantageous to provide an inner body in the borehole of the contact body and to connect the inner body to a drive rod. This inner body presses the cylindrical contact body against the stationary contacts during the closed state of the circuit breaker and consequently improves the distribution of the contact pressure over the entire contact surface. According to one embodiment of the present invention, the inner body is arranged with play in the borehole of the contact body. In most cases, a play on the order of magnitude of 1/10 mm is sufficient. However, it also can be substantially greater. Because the circuit breaking movement of the drive rod must understandably start from zero velocity, the contact body is only moved after the circuit breaking speed of the drive rod has risen, due to the play between the contact and inner bodies. The inner body is preferably constructed as a roller. Consequently, it is possible to achieve a greater contact surface area with the borehole of the contact body. It is further advantageous when the inner body is constructed as a roller to provide a flat surface which is parallel with the axis of the roller. With this design, it is possible for the inner body to contact the borehole of the contact body only in desired locations.

In a preferred embodiment of the invention, the inner body consists of an electrically conducting material. This form of construction provides an advantage in that the inner body increases the electrical and thermal conductivity of the direct-current contact unit in the closed state of the circuit breaker since it is pressed onto the forward surface of the borehole. According to another embodiment of the invention, the inner body consists of an insulating material. In this form of construction, the inner body only provides the mechanical function of moving and supporting the contact body.

It is preferable to provide the contact body with contact plates. This enables a less expensive material to be used for the contact body because the danger of contact burnup is most likely in the area of the contact plates, which can be manufactured from an electrically conducting material which has better heat and fire-resistant properties.

In a further embodiment of the present invention, the contact body consists of at least two similar cylindrical contact bodies arranged coaxially adjacent one another and installed on a common inner body. In this embodiment, a better adaptation of contact surfaces to the surfaces of the fixed contacts is ensured when the contact surfaces lose their original surface shape as a result of burnup or a mechanical deformation, whereby the surface contact of the fixed contacts of the circuit breaker can be optimally distributed. It is preferable to insulate the similar cylindrical contact bodies arranged alongside each other from one another. This insulation prevents any undesired passage of currents between the individual contact bodies arranged alongside one another.

BRIEF DESCRIPTION OF THE DRAWINGS

A more complete understanding of the present invention will be obtained from a perusal of the following description taken in conjunction with the accompanying drawings, in which.

DETAILED DESCRIPTION

Figure 1:
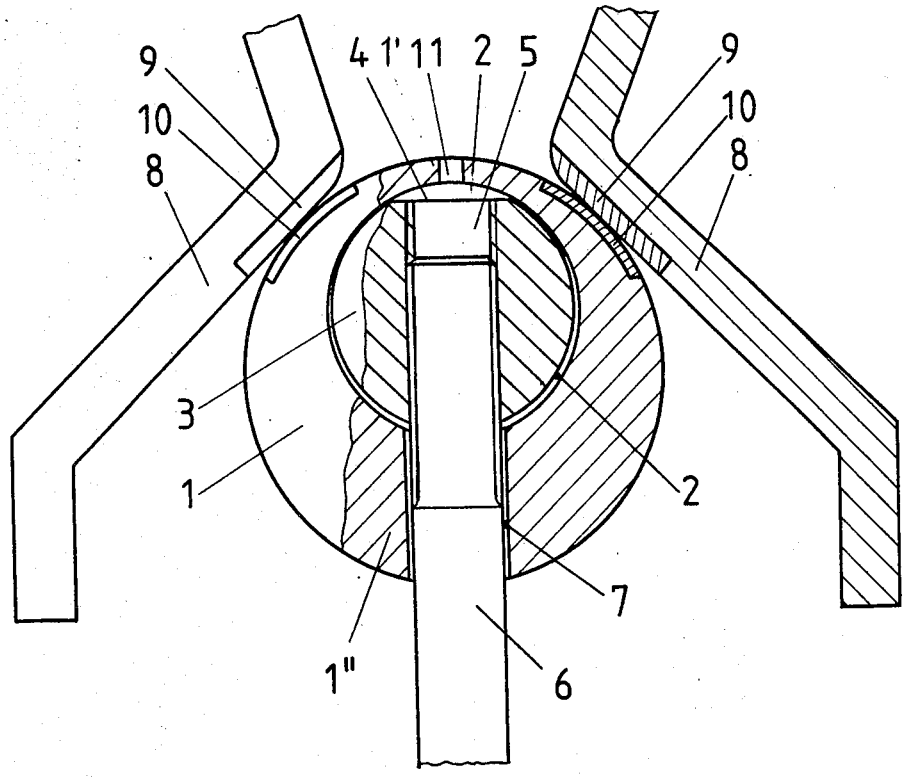
FIG. 1 is a partial cross-sectional view through one embodiment of a direct-current contact according to the present invention in the closed state of a high capacity circuit breaker.

In the embodiment of FIG. 1, a borehole 2 is provided in a cylindrical contact body 1 and extends in the longitudinal direction of the contact body. The axes of the body 1 and the borehole 2 are parallel. The borehole 2 is designed eccentrically with respect to the contact body 1 so that the cross sectional area of the contact body 1 is divided into two current paths. The part of the contact body 1 with a smaller cross sectional area is designated by reference numeral 1', and the part with the larger cross sectional area by the reference numeral 1''. An inner body 3 constructed as a roller is arranged with play in the borehole 2. This play is achieved by having the outer diameter of the cylindrical inner body 3 smaller than the inner diameter of the borehole 2. The upper part of the inner body 3, as viewed in FIG. 1, is provided with a flat surface 4 so that, in the closed state of the circuit breaker, only the parts of the inner body 3 bordering on the flat surface 4 contact the inner surface of the borehole 2. A borehole 5 in inner body 3 houses a drive rod 6 which passes with play through a borehole 7 in the contact body 1.

Electric arc guiderails 8 with contact plates 9 form the stationary contacts of the circuit breaker. Similar contact plates 10 are inserted in the peripheral surface of the contact body 1. Contact plates 9 and 10 are made of a material which is well known for its conducting and heat resistant properties. For example, the contact plates can be made from a silver-cadmium-oxide alloy with a high silver content, from graphite or from graphite reinforced with metal particles. The contact body 1 and the inner body 3 can consist of copper.

In the smaller cross-sectional area 1' of the contact body 1, a radial borehole 11 is provided to further reduce the small cross-sectional area of that part. The radial borehole 11 can also be used as a cooling channel. It is also possible for borehole 11 to be closed with an insulating substance. In this case, it is not used as a cooling channel, but it operates to prevent possible penetration of contamination and burnup components into the borehole 2. In the partial section of FIG. 1, only one radial borehole 11 is shown. It will be apparent, however, that, in the longitudinal direction of the contact body 1, a number of radial boreholes 11 or other openings can be provided.

Figure 2:
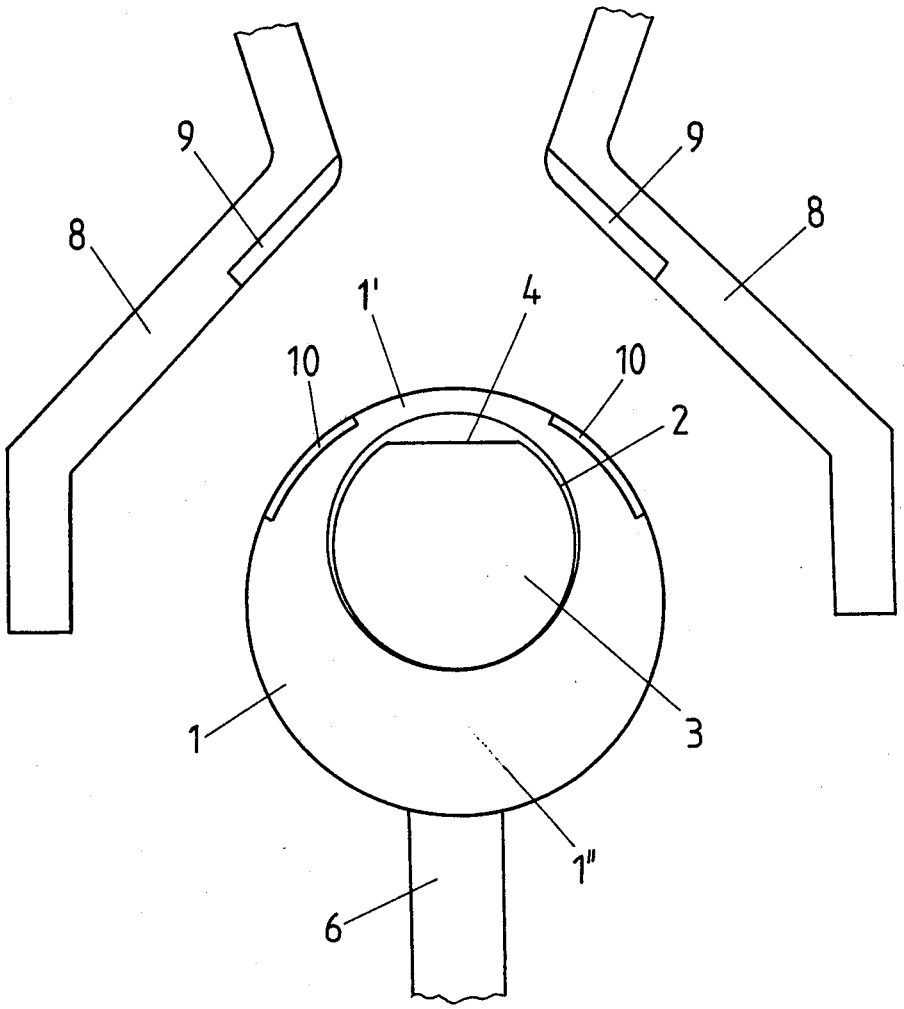
FIG. 2 is the direct-current contact shown in FIG. 1 in the opened state of the circuit breaker.

FIG. 2 illustrates the direct-current circuit breaker of FIG. 1 in the open state. The contact body 1 was drawn from the closed position by means of the drive rod 6 and the inner body 3. The contact between the inner body 3 and contact body 1, at the upper portion of the direct-current contact as shown in the Figure, is interrupted, resulting in a current loop which flows predominantly through the greater cross sectional portion 1 of the contact body 1.

Figure 3:
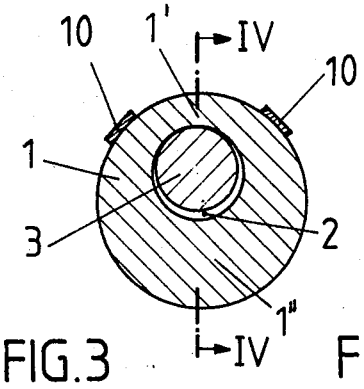
FIG. 3 is a second embodiment of the present invention with flat contact plates in cross section along line III—III of FIG. 4.
Figure 4:
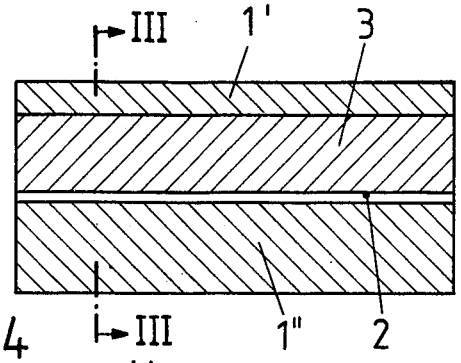
FIG. 4 illustrates the embodiment of FIG. 3 in longitudinal section along the cross sectional line IV—IV of FIG. 3.

The embodiment illustrated in FIGS. 3 and 4 shows another form of construction of the present invention. The contact plates have flat contact surfaces and are fastened to the outer surface of the contact body 1. The drive rod 6 illustrated in FIGS. 1 and 2 is not shown in this example, but it is apparent that a drive rod can be used to move the contact unit.

Figure 5:
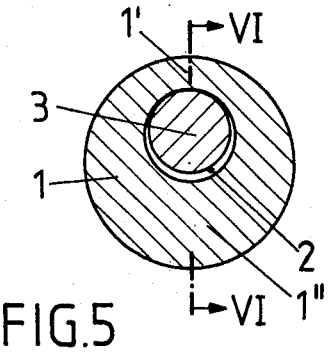
FIG. 5 is a cross sectional view of a further embodiment in which the contact body consists of a number of contact bodies arranged coaxially alongside one another, taken along the line of V—V of FIG. 6.
Figure 6:
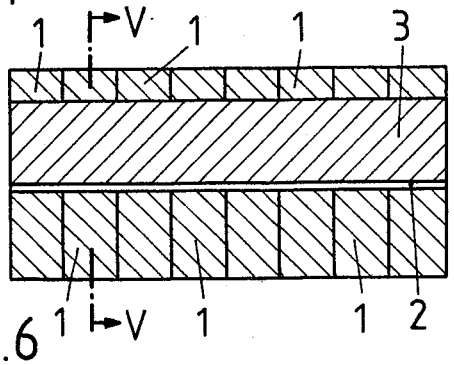
FIG. 6 is the longitudinal cross section along line VI—VI of FIG. 5.

The embodiment of FIGS. 5 and 6 illustrates a variation in which the contact body consists of a number of separate contact bodies 1 arranged alongside one another. The separate contact bodies can be produced from a coppersilver alloy and are not provided with contact plates. The common inner body 3 consists of any well-known insulating material. The inner body can be connected with the drive rod (not shown) by means of any well-known bracket arrangement (not shown) which is attached to the inner body on both sides of the inner body 3.

Figure 7:
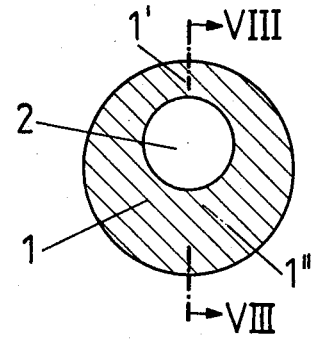
FIG. 7 is a further embodiment in which the borehole in the contact body is empty, taken in cross section along the line VII—VII of FIG. 8.
Figure 8:
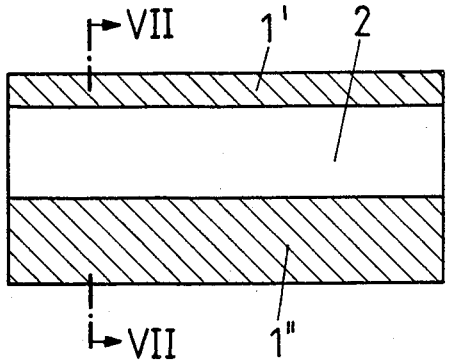
FIG. 8 is the longitudinal cross section along line VIII—VIII of FIG. 7.

The embodiment illustrated in FIGS. 7 and 8 shows a cylindrical contact body 1 made of graphite. The borehole 2 in the contact body 1 is empty. It contains no inner body and the drive rod (not shown) can be fastened directly to the wider part 1' of the contact body 1.

It will be apparent to those of ordinary skill in the art that the present invention is not limited to the disclosed embodiments. It is possible, for example, to arrange insulating disks between the individual contact bodies 1 or to provide the front surfaces of the individual contact bodies 1 with insulating layers, in the embodiment of FIG. 6. The inner body 3 can be constructed in a form other than the round one depicted, and the radial boreholes 11 can also be used in other variations.

The presently disclosed embodiments are therefore considered in all respects as illustrative and not restrictive. The scope of the invention is indicated by the appended claims rather than the foregoing description, and all changes which come within the meaning and range of equivalency of the claims are therefore intended to be embraced therein.

What is claimed is:

1. An electrical direct-current contact unit for use in a direct-current, high-capacity circuit breaker, comprising a cylindrical contact body and an eccentrically arranged borehole provided in the contact body and extending in a longitudinal direction of the contact body to form two current paths of different cross-sectional area, whereby the current present in the contact body during the opening of the circuit breaker forms a loop to enhance magnetic quenching of electric arcs formed during a circuit breaking operation.

2. A direct-current contact according to claim 1, further including an inner body installed in the borehole and a drive rod connected to said inner body.

3. A direct-current contact according to claim 2, wherein the inner body is installed in the borehole with play.

4. A direct-current contact according to claim 2, wherein the inner body is constructed as a roller.

5. A direct-current contact according to claim 2, wherein the inner body is constructed as a roller having one flat surface parallel with the axis of the roller.

6. A direct-current contact according to claim 2, wherein the inner body consists of an electrically conducting material.

7. A direct-current contact according to claim 2, wherein the inner body is made of an insulating material.

8. A direct-current contact according to claim 1, further including contact plates provided on the contact body.

9. A direct-current contact according to claim 2, wherein the contact body comprises at least two uniform cylindrically shaped contact bodies installed coaxially adjacent one another and arranged on a common inner body.

10. A direct-current contact according to claim 9, wherein the uniform cylindrical contact bodies installed adjacent one another are insulated from each other.

* * * * *